US007346955B2

(12) United States Patent
De Laforcade

(10) Patent No.: US 7,346,955 B2
(45) Date of Patent: Mar. 25, 2008

(54) APPLICATOR STRUCTURE IN THE FORM OF A GLOVE

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 602 days.

(21) Appl. No.: 10/729,022

(22) Filed: Dec. 8, 2003

(65) Prior Publication Data

US 2004/0210979 A1 Oct. 28, 2004

Related U.S. Application Data

(60) Provisional application No. 60/441,487, filed on Jan. 22, 2003.

(30) Foreign Application Priority Data

Dec. 6, 2002 (FR) ..... 02 15461

(51) Int. Cl.

| | |
|---|---|
| ***A41D 19/00*** | (2006.01) |
| ***A41D 19/01*** | (2006.01) |
| ***A47L 13/18*** | (2006.01) |
| ***A47L 13/19*** | (2006.01) |

(52) U.S. Cl. ..... 15/227; 15/209.1; 15/104.94; 2/158; 2/159; 2/161.6; 2/167

(58) Field of Classification Search ..... 15/229.1, 15/227, 247, 104.94, 229.4, 229.8, 228, 209.1, 15/210; 2/158, 159, 16, 161.6, 167
See application file for complete search history.

(56) References Cited

U.S. PATENT DOCUMENTS

| | | | | |
|---|---|---|---|---|
| 1,254,913 | A * | 1/1918 | Kitamura | 15/227 |
| 2,704,372 | A | 3/1955 | Criger | |
| 3,874,014 | A | 4/1975 | Davey | |
| 5,979,007 | A * | 11/1999 | Soon | 15/227 |
| 6,047,435 | A * | 4/2000 | Suzuki et al. | 15/229.8 |
| 6,637,035 | B1 * | 10/2003 | Brinkmann et al. | 2/161.6 |
| 6,813,801 | B2 * | 11/2004 | Tanaka et al. | 15/229.3 |
| 6,829,802 | B2 * | 12/2004 | McKenzie | 15/227 |
| 2002/0000017 | A1 * | 1/2002 | Brown et al. | 15/227 |
| 2002/0107528 | A1 | 8/2002 | Vayrette | |

FOREIGN PATENT DOCUMENTS

| | | |
|---|---|---|
| EP | 0 820 705 | 1/1998 |
| FR | 550 332 | 3/1923 |

(Continued)

*Primary Examiner*—Gary K. Graham
(74) *Attorney, Agent, or Firm*—Oblon, Spivak, McClelland, Maier & Neustadt, P.C.

(57) ABSTRACT

A device that can be used, for example, for application or use with hair care products. The device includes two sheets connected to one another by a connecting region which defines a cavity on a first side of the connecting region, such that a user's hand can be inserted into the cavity. A flexible strip preferably cut into fringes and flaps, is provided on a second side of the connecting region. A method for manufacturing a device of this kind is also provided in which two webs of strip material are unrolled simultaneously, connected, and then cut. Parts of the webs, including both the connecting region and the cut fringes and flaps, are then separated. The device can optionally be impregnated with a product, for example, a hair care product.

36 Claims, 3 Drawing Sheets

FOREIGN PATENT DOCUMENTS

| | | |
|---|---|---|
| GB | 2 035 052 | 6/1980 |
| JP | 54-132427 | 9/1979 |
| JP | 09-112 | 3/1997 |
| JP | 3090178 | 9/2002 |
| JP | 2002-306366 | 10/2002 |
| WO | WO 00/57737 | 10/2000 |
| WO | WO 03/051739 | 6/2003 |

* cited by examiner

APPLICATOR STRUCTURE IN THE FORM OF A GLOVE

CROSS-REFERENCE TO RELATED APPLICATIONS

This document claims priority to French Application Number 02 15461, filed Dec. 6, 2002, and U.S. Provisional Application No. 60/441,487, filed Jan. 22, 2003, the entire contents of which are hereby incorporated by reference.

BACKGROUND OF THE INVENTION

1. Field of the Invention

The present invention relates to an applicator structure in the form of a glove. The invention can be particularly advantageous for gloves used to massage and/or apply a product to the hair and scalp.

2. Discussion of Background

Toiletry gloves for the body are known. Such gloves are generally made of cotton or a sponge material. The advantage of the invention is that it provides a glove making it possible to better contact the full body of hair, while limiting the hand actions required for obtaining this result.

In its simplest embodiment, a toiletry glove or mitt has a rectangular shape produced so that two fabric panels are connected in order to provide an opening level with one of the edges of the rectangle, so that a user's hand can be inserted between the two fabric panels. The user may optionally wet and impregnate his or her glove with a body hygiene product, in order to apply the product to his or her skin.

In order to meet the needs of traveling customers, who have little access to sources of water, gloves have been developed which are impregnated with body hygiene products that are effective even for dry application. In particular, flannels (generally rectangular pieces of fabric) are known which can be impregnated with various products such as makeup remover products, foaming products for cleaning the skin, or deodorant and/or freshening compositions.

If such flannels are used in the field of hair, for example ones impregnated with hair care products, problems are encountered in that they are difficult to handle and the product performance is less than optimal. One difficulty with this type of product is that the flannel rolls up quickly when massaging the hair. It is therefore necessary to hold the flannel firmly in the hand, but this hand action is incompatible with the hand actions appropriate for ensuring maximum contact with the body of hair. Massage is consequently obtained only at the surface, rather than in the body of the hair or throughout the hair.

It is known to use gloves for improved massage of the body of the hair. These gloves fit closely around the user's hand and allow him or her to penetrate into the body of the hair with each glove finger.

GB-A-2,035,052 discloses a waterproof glove for massaging the hair when applying a shampoo. This glove has small conical protuberances on each of the fingers of the glove, extending radially from the outer surface of the glove fingers. This glove is molded of a plastic material. It is therefore not a good medium to be impregnated with cosmetic or hygiene products. In fact, absorbent materials are preferably chosen for impregnation with a hygiene product which is intended for application to the skin or the hair.

Absorbent materials can be used such as those provided for the production of flannels. However, impregnated gloves made from such materials can be costly to manufacture. This is because, in order to produce a glove with individualized fingers, two sheets of absorbent fabric are bonded together and they are then cut according to a template to have individual fingers. There is therefore a loss between the amount of fabric which is used and the amount ending up in the gloves actually produced. These losses are unrecoverable or require a recycling stage to recover a portion of the lost material. A further difficulty is that once the gloves have been manufactured, they form a corresponding number of packaged units to be impregnated with a product, and the handling of each of these units is difficult. It is moreover difficult to impregnate the fabric beforehand because it can require manual cutting which is time-consuming and laborious. Manual cutting of the gloves also generates a risk of bacterial contamination, and demands an additional stage of sanitizing the gloves which are produced. This last stage will place a further burden on the manufacturing process and manufacturing cost.

SUMMARY OF THE INVENTION

It is an object of the present invention to overcome the drawbacks mentioned above by providing a glove forming a cavity into which a user can insert his or her hand. This glove includes portions which extend from an outer contour of the glove, so as to increase the contact area provided by the glove. In particular when the user wearing this glove passes his or her hand through a body of hair, the extending portions of the glove provide a corresponding number of additional areas for contact with the hair. These portions correspond here to an extension of the constituent material of the glove, beyond the strict outer contour of the cavity into which a hand can be inserted. Indeed, when a user inserts his or her hand into the glove, and in particular one of his or her fingers into one of the fingers of the glove, the glove finger has a loose portion around the outer contour even if its inner contour fits closely around his or her finger. The glove produced in this way has a contact area formed by the outer contour of the glove fingers and of the glove, and additionally by the outer surface presented by the extending portions.

In one example of the invention, the cavity into which the hand is inserted can be delimited by a junction region or connecting region, with the connecting region connecting a first panel to a second panel. The hand is inserted into a cavity between these two panels through an opening which is not closed by the connecting region.

The arrangement provides a glove which develops a large contact area, making it possible to massage the hair while coming in contact with the outer contour or outer surfaces of most of the hair. Better massaging or contact of the hair is thereby obtained. For example, when used to wash the hair, or apply a treatment thereto for care, dyeing or the like, more uniform results are achieved where contact is made with a greater number of hairs, preferably with contact made for each hair as much as possible throughout the depth of the body of the hair. The invention makes it possible to obtain improved results by improving contact with the hair.

In accordance with one form, the invention provides a device including a first sheet and a second sheet, with the first sheet being connected to the second sheet in a connecting region, and with a cavity formed between the two sheets on one side of the connecting region. In addition, the device has at least one flexible strip, formed by at least one of the sheets, on the other side of the connecting region, with the two sheets respectively having a polygonal shape, and the cavity being oriented obliquely relative to the sheets. The cavity is accessible via at least one opening such that a hand can be inserted into the cavity. In a preferred example, the polygonal sheets are rectangular.

With the assembled sheets respectively having substantially polygonal shapes, the cavity is preferably oriented obliquely relative to the sheets in order to provide a maximum length for the flexible strip, especially when the connecting line delimits a glove shape or portion of the glove. Such an orientation preferably leads to the opening of the glove being present in one corner of the rectangle, with the connecting region respectively opening onto two separate and orthogonal edges of the two sheets. The cavity extends along an axis of preferential elongation or a major axis, with this axis of elongation passing through the at least one cavity positioned at a corner of adjacent sides of the polygonal sheets, and with the axis of elongation being not parallel to the adjacent sides of the polygonal sheets such that the cavity is oriented obliquely relative to the polygonal sheets. Thus, with the sheets polygonal, e.g., rectangular, the opening can be provided at an intersection or corner of two sides of the polygon, with a portion of the opening on one side of the polygon and a portion of the opening on another adjacent side of the polygon. The hand is then introduced into the glove so that it preferably extends along a diagonal of the rectangle. It is therefore easy to limit the proportion of flexible strip which will then be arranged around the wrist of a hand introduced into such a glove, and to maximize or increase the area of the sheets which could, for example, be brought in contact with hair by conventional hand actions.

In order to simplify the manufacturing method and obtain a certain tolerance for the placement of the two sheets facing one another, each of these two sheets can have flexible strips. For example, the two sheets can have the same dimensions and be superimposed so that the flexible strips have the same shape and are superimposed.

In a preferred form, in order to improve the contact with each of the hairs of a body of hair, the flexible strip(s) form(s) fringes. The fringes are themselves flexible and can be oriented indiscriminately with respect to one another in the body of hair. The fringes will thus create random or unconstrained additional contact areas.

In order to expand these random orientations, and thus to increase contact, a fringe can include at least two flaps. The flaps are, for example, cut along an intermediate axis secant to a longitudinal axis of the fringe.

The connecting region preferably forms at least one curve so that the cavity has at least one projection for accommodating at least one finger. The connecting region more preferably delimits a plurality of projections, each for respectively accommodating one finger of a hand, so that the cavity defines a glove. At least one projection is furthermore extended by at least one fringe.

At least one of the sheets can include or consist of a nonwoven material. This type of nonwoven material may be at least partly impregnated with a cosmetic product, in particular a hair treatment product.

In one variant, the connecting region is discontinuous. In this case, the cavity has a plurality of openings.

The invention also makes it possible to obtain such gloves by a simplified manufacturing method with a low cost price and which is easy to use industrially. This is because the manufacturing method according to the invention avoids or reduces material losses. In addition, the cutting of the gloves is simplified and can be carried out continuously without interrupting the manufacturing line.

In accordance with one example, the method includes assembling two polygonal rectangular sheets of material in a junction region so as to form a cavity between the two sheets on one side of the said junction region, with cavity being accessible via at least one opening. The junction region is arranged so that at least one of the sheets forms a flexible strip on the other side of the junction region, and so that the cavity is oriented obliquely relative to the sheets. Preferably, the opening is provided at a corner of adjacent sides of the polygonal sheets. In an illustrated example, the polygonal sheets are rectangular.

Preferably, the flexible strip defined in this way is then cut so as to define the positions of the portions. These extending portions, or fringes, may themselves be cut so as to present flaps. The portions and their flaps can be, for example, produced by cutting using a punch.

According to one form of the method, the gloves can be continuously produced from at least one web of continuous strip material in which the cutouts of the portions do not join the edges of the web. The latter is hence easy to handle. In this case, the sheets are cut during a last stage, for example by cutting with a roll, so as to separate the gloves formed in this way from the web(s) of strip material.

More particularly, in one form providing a continuous method, the two sheets can be formed from two strips arranged on rolls which are unrolled simultaneously. Alternatively, the two sheets can be formed from a strip which is unrolled and folded on itself about its longitudinal axis, with the longitudinal axis preferably being defined parallel to an unrolling axis of the web.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
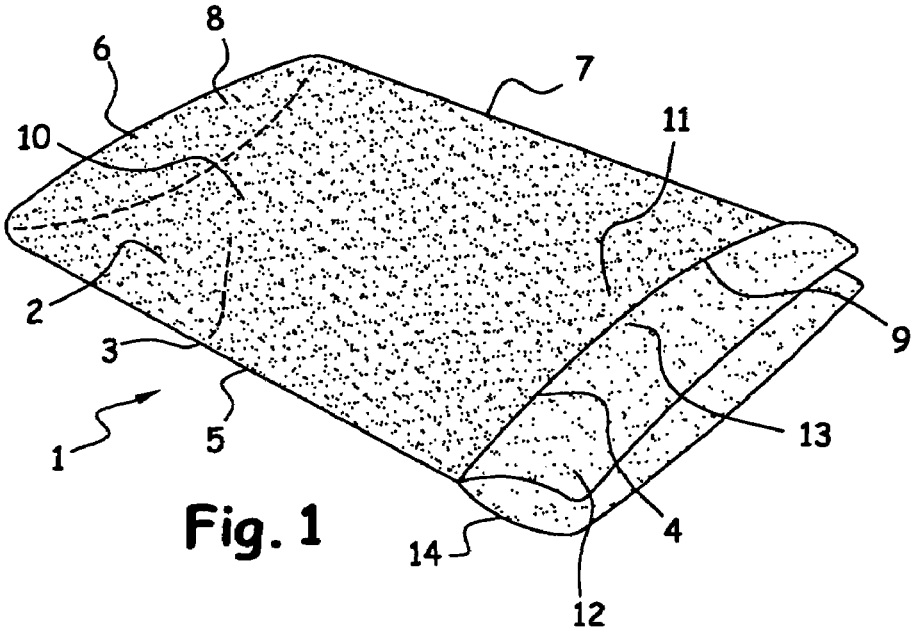
FIG. 1 shows a profile view of a hollow device according to the invention.

FIG. 1 shows an example of a device 1 according to the invention. The device 1 includes a pouch. In the illustrated arrangement, the device includes a first sheet 2, here represented as an upper sheet of the device 1, and a second sheet 3 respectively represented as a lower sheet. In this example, the sheets 2 and 3 face one another and are superimposed. The sheets are connected in a connecting region 4, so as to delimit the pouch at least on one side of the connecting region 4. This connecting region 4 includes at least one curvature so that the pouch is present on the inner side of the curvature. The pouch also includes an opening so that a user's hand can be introduced between the sheets assembled in this way. The connecting region 4 is preferably defined on the inside of the sheets of the device 1, rather than on their contour.

The connection between the two sheets 2 and 3 can be made by suitable apparatus for various connecting or fastening expedients, for example, adhesive bonding, thermal welding, ultrasonic or high frequency welding. The fastening/connecting expedient should be chosen so that it is appropriate for the constituent material of the sheets.

The sheets are preferably made of a nonwoven material. By way of example, and not to be construed as limiting, one such advantageous non-woven material includes 70% viscose and 30% polyethylene terephthalate. Preferably, an absorbent material is utilized so that it can be impregnated with a solution. Also preferably, the material is impregnated, for example, with a body hygiene product, or a product for hair care, such as a shampoo, a dye, a rehydrater or a hair fixative (product capable of setting the hair fiber). The sheet has, for example, a flat shape with a small thickness and with a density on the order of 70 grams/m2.

In the example represented in FIG. 1, the sheets 2 and 3 are polygonal. More particularly, the sheets illustrated are rectangular and have at least three common borders 5, 6, 7 strictly facing one another. Of these three borders, the borders 5 and 7 are connected via the connecting region 4, whereas the border 6 is referred to as "open" since the two sheets 2 and 3 are not connected at this border 6. The border 6 therefore has an opening 8. A user may, for example, insert his or her hand through the opening 8 so as to place it between the two sheets 2 and 3.

The connecting region 4 is continuous in the example presented in FIG. 1. Specifically, a segment 9 of the connecting region 4 connects the borders 5 and 7. The sheets 2 and 3 are connected in this segment 9. The device 1 therefore defines a cavity 10 between the two sheets 2 and 3. The cavity 10 is accessible only from the opening 8.

With respect to the connecting region 4, the cavity 10 is on a first side 11 of the segment 9, that is to say on the left in FIG. 1, whereas a flexible strip 12 is defined on a second side 13 of the segment 9. The flexible strip 12 corresponds to a part of one of the sheets 2 or 3 extending beyond the connecting region 4. In FIG. 1, the first sheet 2 continues beyond the connecting region 4 to form this flexible strip 12. The segment 9 of the connecting region 4 is therefore not provided at the border of the sheet 2, but rather, the connecting region is spaced from the border of the sheet 2. The flexible strip is thus provided as an extension of one of the sheets, with one end coupled at the connecting region and another end a free end. As can be seen in FIG. 1, the extension or flexible strip is provided on a side of the connecting region 4 opposite to the side on which the cavity of the pouch is formed, such that the extension is provided exteriorly of the cavity. The flexible strip 12 is movable with respect to the rest of the sheet 2 which, for its part, is held securely with the second sheet 3. For example, the flexible strip 12 extends orthogonally to the segment 9 over a length of the order of one centimeter. This length is, for example, between 0.5 centimeter and 5 centimeters.

In one variant, the connecting region 4 may be discontinuous, so long as the device 1 has at least one projection such as the flexible strip 12.

In another variant, as shown in FIG. 1, the two sheets 2 and 3 can each have a flexible strip such as 12. In this case, the second sheet 3 has a second flexible strip 14. The flexible strips 12 and 14 are not required to have the same shape nor are they required to be superimposed exactly. They are independent from one another. Accordingly, it is to be understood that the sheets 2 and 3 do not necessarily have the same shape, and may face one another only partially.

The flexible strip may, for example, extend over the full length of the connecting region 4. Alternately, the flexible strip 12 can extend beyond the second side 13 over some of the connecting region 4 or portions of the connecting region 4.

Figure 2:
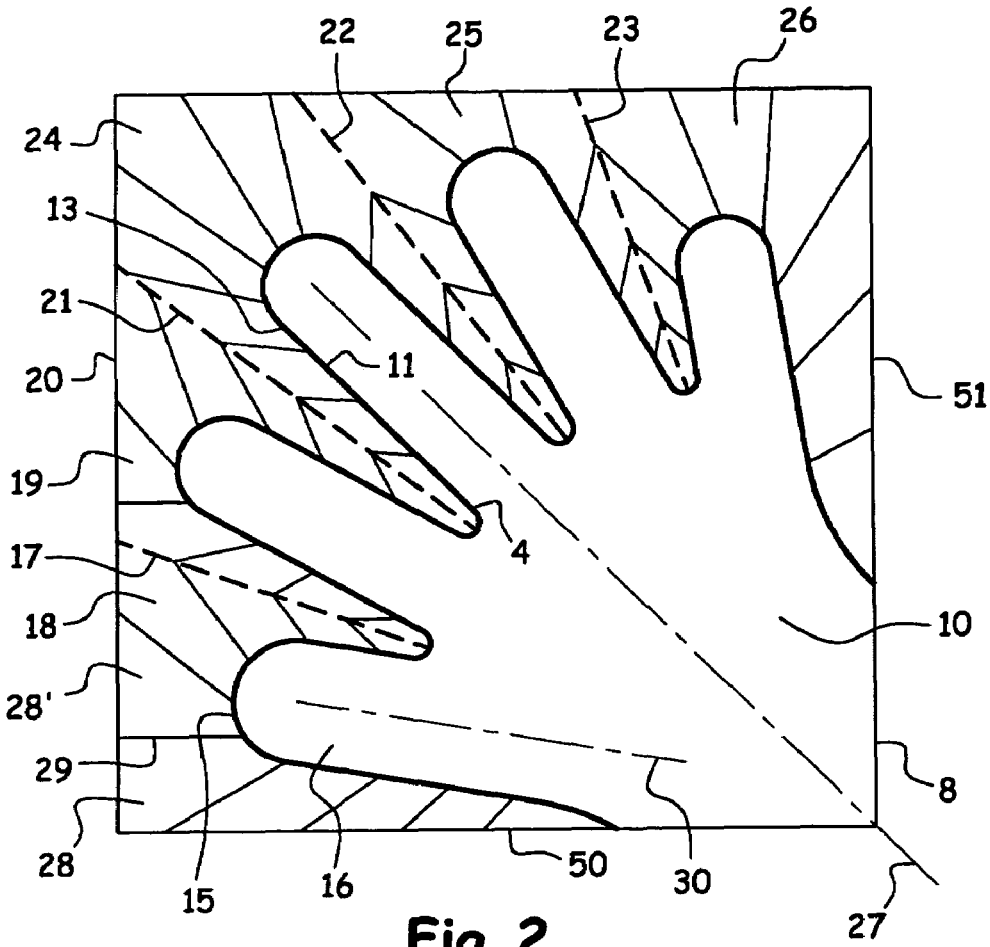
FIG. 2 shows a plan view of a preferred embodiment of a device according to the invention.

In a preferred embodiment, which is illustrated in FIG. 2, the device 1 forms a rectangle in which the connecting region 4 is continuous and has at least one curve 15 intended to form a projection 16 of the cavity 10. The projection 16 more particularly forms a tubular extension of the cavity 10. This tubular extension 16 is preferably arranged to be able to accommodate a finger of a user's hand. The connecting region 4 preferably forms a plurality of curves, which are connected together in order to form a plurality of tubular extensions 16. For example, the cavity 10 can have five tubular extensions such as 16, each for receiving one finger of a hand as shown in FIG. 2. In this case, each of the five extensions preferably has an inner contour whose shape is compatible with the finger that it is supposed to accommodate: thumb, index finger, middle finger, ring finger or little finger. Although five individual finger extensions are shown in the illustrated embodiment, a fewer number of extensions could be provided, with one or more of the extensions arranged to hold plural fingers.

The pouch can thus define a glove on the first side 11 of the connecting region 4. On the second side 13 of the connecting region 4 is the flexible strip 12, and optionally the flexible strip 14, which extend(s) beyond the connecting region 4.

Thus, the arrangement of FIG. 2 includes plural flexible strips formed as extensions of one or more of the sheets forming glove, with the extensions extending exteriorly of the cavity, i.e., on a side of the connecting region opposite to the side within which the cavity for receiving a hand is provided. In order to the release or separate the fingers of the glove from one another, a cutout 17 of the flexible strip 12 is made. The strip 12 is then separated into at least two fringes, 18 and 19 respectively. In the illustrated example, the cut 17 is made in the flexible strip 12 along an axis secant to the connecting region 4, and substantially until it reaches the connecting region 4. The cutout 17 is furthermore made as far as a border 20 of the surface, here of rectangular shape, in which the device 1 is circumscribed. The two fringes 18 and 19 are therefore each held in the connecting region 4 coupled to the sheet 2. In the illustrated arrangement, the fringes 18 and 19 are also delimited by the cut or separation 17 and the border 20 of the rectangle.

In the event that the glove has five fingers, four cutouts such as 17 are produced for this purpose, respectively 17, 21, 22 and 23. Therefore, the flexible strip 12 is then divided into five fringes, 18, 19, 24, 25 and 26 respectively. For example, the cutout 17 makes it possible to separate the "thumb" from the "index finger" with the fringe 18 being defined around the "thumb." The cutout 21 separates the "index finger" from the "middle finger" with the fringe 19 then being defined around the "index finger." The cutout 22 separates the "middle finger" from the "ring finger" with the fringe 24 being defined around the "middle finger." The cutout 23 separates the "ring finger" from the "little finger" with the fringe 25 being defined around the "ring finger." The last fringe 26 is defined around the "little finger."

A longitudinal axis 27 of a hand is defined as being that of the forearm, in continuation of which it is circumscribed, especially when the fingers are parallel to the forearm. The opening 8 is preferably produced so that the longitudinal axis 27 of the hand is oblique with respect to the polygon in which the glove is formed. As shown, the axis of elongation or major axis of the cavity extends obliquely relative to the sides of the polygonal sheets. In FIG. 2, the opening 8 is defined in a corner of this rectangle. To this end, the connecting region 4 opens at two points of the outer contour of the polygon, on either side of this corner, defining the opening 8 between these two points. As shown, in the illustrated preferred embodiment, the polygonal sheets are rectangular. Thus, the device can be formed of a polygonal sheet or sheets, preferably by rectangular sheets, and the opening into the cavity can be provided at a corner between adjacent sides of the polygon, preferably with a portion of the opening extending along part of one side of the polygon of each of the sheets and another portion of the opening extending along an adjacent side of the polygon of each of the sheets. Here, a first point opens level with or along one edge 50, and the second point opens level with or along a second edge 51 adjacent to the first edge 50, the two edges 50 and 51 being presented as orthogonal in this case.

In the event that the device 1 has two flexible strips 12 and 14, provided respectively by extensions of the sheets 2 and 3 beyond the connecting region 4, the second flexible strip 14 preferably also has fringes such as those of the strips 12. The fringes 17 of the two strips 12 and 14 are preferably cut simultaneously.

Figure 3:
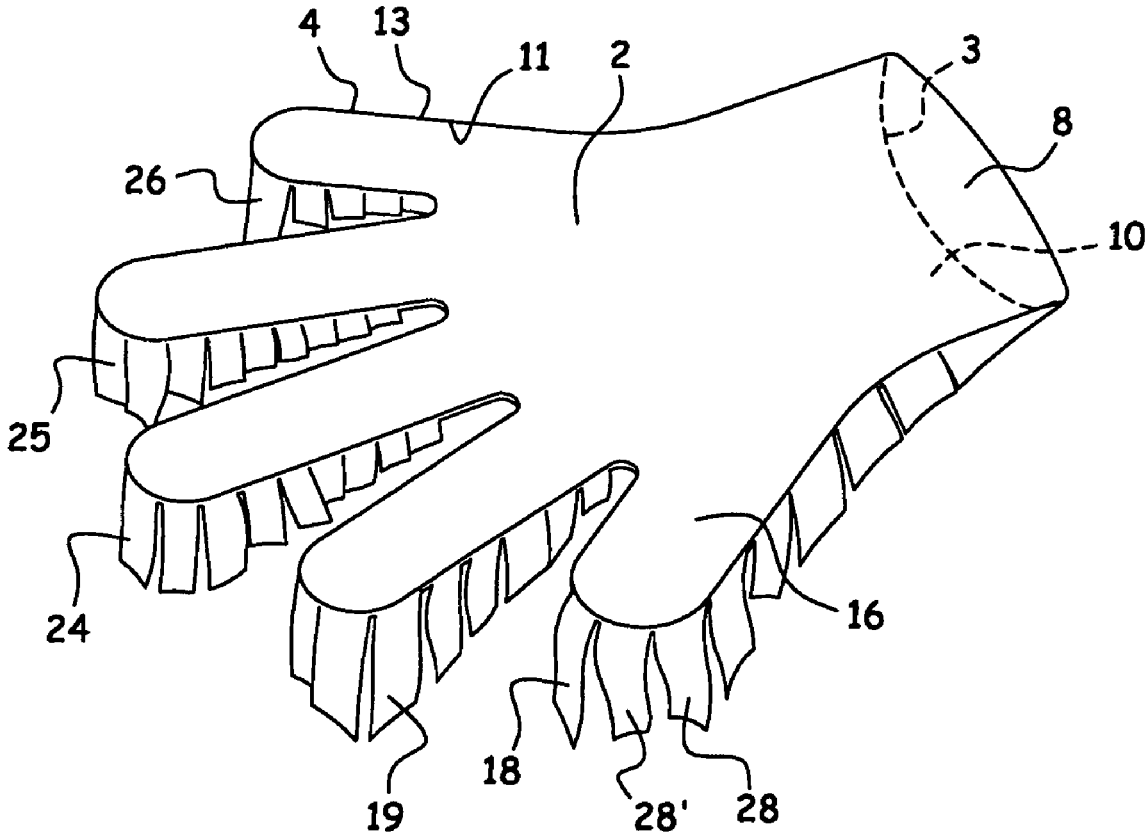
FIG. 3 shows a profile view of a preferred embodiment of a device according to the invention.

The fringes may themselves be cut so as to have at least two flaps as represented, for example, at 28 and 28' in FIGS. 2 and 3. These flaps are produced along intermediate cut axes as shown at 29 in FIG. 2. For example, in the illustrated embodiment, the fringe 18 has at least one intermediate cutout axis 29, thus defining the at least two flaps 28 and 28'. In FIG. 2, the fringe 18 has seven flaps such as 28 and 28', separated by six intermediate cutouts such as 29. The axes of each of these intermediate cutouts 29 will be secant with the connecting region 4. For example, each flap has an edge represented by a part of the connecting region 4. In one variant, the flaps may be cut along mutually parallel axes, in which case all the flaps do not have an edge formed by the connecting region 4. Thus, flexible extensions of one or both of the sheets can be provided as flexible strips, fringes or flaps, which extend externally of the cavity that receives a hand. Some or all of the extensions can have a first end coupled to the connecting region and a second end which is a free end.

A longitudinal axis 30 of a fringe is preferably defined which corresponds substantially to the principal extension axis of a projection 16, that is to say to an axis along which a finger is inserted into the projection. The connecting region 4 has connecting parts curved on either side of this longitudinal axis 30. The intermediate cutout axes 29 are then secant with this longitudinal axis 30.

The presence of the fringes and the flaps makes it possible to increase the area of the glove, and in particular to make full use of all the material included in the surface, here of rectangular shape, inside of which the glove is defined. As represented in FIG. 3, the fringes and flaps substantially increase the contact with the hair surface and furthermore improve the massaging of the scalp. The fingers separate the body of hair into a plurality of locks, these locks being indiscriminately penetrated by the various flaps and fringes.

The method for manufacturing the device 1 can be carried out in a plurality of stages. A presently preferred example of a manufacturing method is described below.

In a first stage, the two sheets 2 and 3 are assembled together. In the case of a continuous method for manufacturing a plurality of devices such as 1, the sheets 2 and 3 are defined within at least one web of a continuous strip of material.

Figure 4:
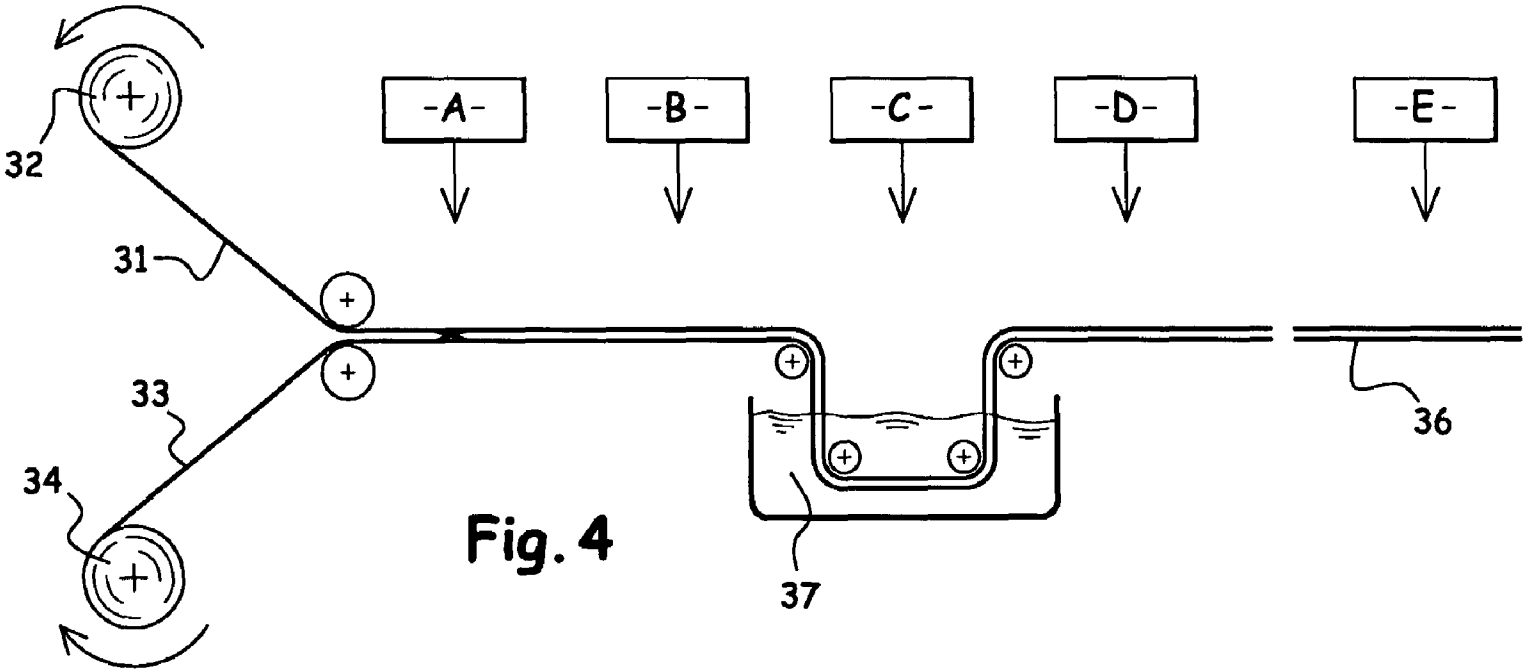
FIG. 4 shows a diagram of the method for manufacturing a hollow device according to the invention.
Figure 5:
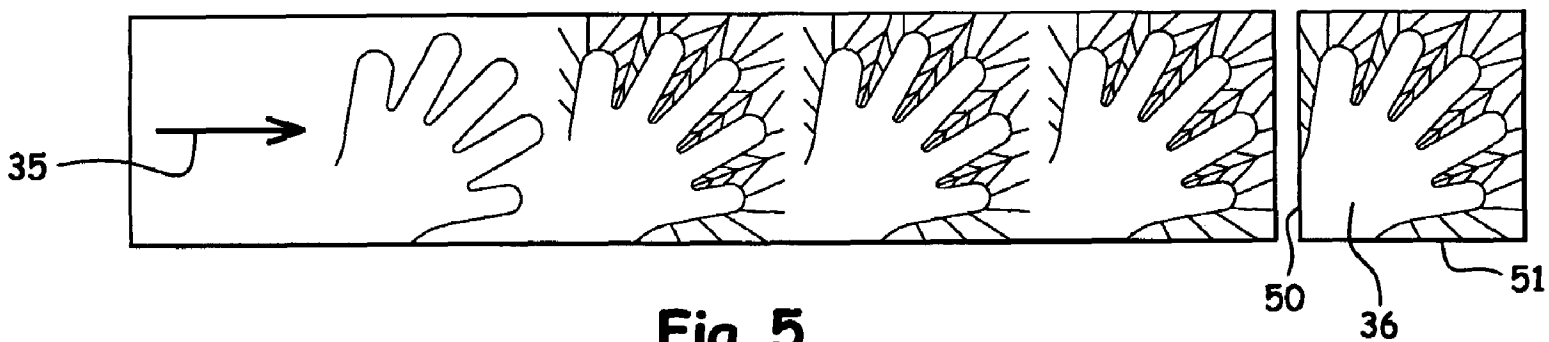
FIG. 5 shows a plan view of a web employed during the method in FIG. 4.

In FIG. 4, the sheet 2 is present on a first web 31, stored in the form of a roll 32, and the second sheet 3 is present on a second web 33, stored in the form of a second roll 34. In this case, the rolls 32 and 34 are unrolled simultaneously so as to present the two webs 31 and 33 facing one another. The rolls are unrolled along the arrow 35, i.e., from left to right in FIGS. 4 and 5.

As an alternative to continuously manufacturing the device with a pair of rolls and webs, a single roll can be used so that, when it is unrolled, the corresponding web of continuous strip material has a width allowing it to be folded on itself and thus present two layers, or strip parts, in order to form the two sheets 2 and 3 respectively facing one another. The web is folded about its longitudinal axis, for example, about its principal extension axis, when it is progressively unrolled. Thus, although a pair of rolls are depicted for forming the two sheets 2, 3, the sheets could also be formed from a single roll.

During a second stage represented at A, the two sheets 2 and 3 are connected to one another at least in a connecting region 4. The connection is, for example, carried out by adhesive bonding and/or by welding, for example thermal or ultrasonic welding.

The web(s) is (are) conveyed by a mechanical device which unrolls the roll(s). When the web is unrolled, it is conveyed under or through an apparatus which forms the connection. The apparatus produces the pattern of the connecting region at regular intervals on the web which is moving therepast. A strip having a plurality of connecting lines is thus obtained, subsequently making it possible to create a plurality of devices such as 1. The regularity with which the pattern of the connecting region is produced will preferably be defined as a function of the delivery speed of the web.

By way of example, the connecting-region can be formed to extend as far as a free edge of the web, with this free edge being defined parallel to the longitudinal axis of the web. The free edge of the web is therefore the one which will, for example, become the second edge 51.

The sheet, or where appropriate the web part, containing the connecting region 4 is then subjected to cutting during a third stage B. This cutting makes it possible, in particular, to form the cut such as 17 and also the intermediate cut such as 29. The web 31, seen from above in FIG. 5, then has the pattern of the connecting region as well as that of the cutouts, for example, as shown at 17 and 29 in FIG. 2.

The cuts provided during this third stage B can be produced, for example, using a punch. For example, a cylinder can be provided for the cutting, with the cylinder having blades positioned on its outer contour according to the pattern of the cuts to be made in the web which is moving under it. If the position at which the cuts are formed is to be offset with respect to the connecting region 4, the speed of rotation of the bladed cylinder is also regulated as a function of the delivery speed of the web, so that the cuts are formed at the desired locations on the web and extend, for example, substantially as far as the connecting region 4.

In a variant which is not represented, in order to facilitate the conveying of the webs, the patterns can be cut so that they are not initially completely separate from the rest of the web. This modification can be advantageous in that even after having been initially cut, the web can more easily remain substantially flat without pieces which run the risk of extending out the plane formed by this web. The initial cuts thus form, for example, only indentations or scored portions in the web, rather than fully separated portions, since a complete cut does not extend to an edge of the web in this variant. Thus, it is to be understood that the initial cutting need not be a complete through-cut or separation along the length of the portions that ultimately will be separated, but rather, the cut could be a partial cut, a score, perforations, combinations of the foregoing, etc. Where the various flexible strips, flanges and/or flaps are only partially cut or partially separated initially, full separation can be performed later in the manufacturing process, or alternatively, the user can perform the final separation along the partially separated or weakened lines prior to use.

Lastly, during a final stage E, the part inside which the connecting region 4 and the cutouts 17 and 28 are circumscribed is separated from the rest of the web(s). This last stage makes it possible, for example, to separate a rectangle 36 from the rest of the web by passing the webs under a cutting roll. This last stage provides a cut which defines especially the borders 20 of the polygons such as a rectangle 36, and in particular the first edge 50. If not previously cut in an earlier cutting operation, the rectangle 36 can be cut so that the connecting region 4 opens at two points of this border 20, so as to form an opening 8 between these two points. In the illustrated arrangement, by way of example, the connecting region 4 is furthermore arranged to be continuous inside the rectangle 36, in order to form or delineate the inner contour of a glove.

According to an optional variation, an impregnation stage C can be provided, optionally also followed by a drying stage D. The impregnation and drying can be performed prior to the final stage E. In the illustrated example, the stages C and D can, but need not, be performed on all or substantially all of one or both sheets. Instead, the optional impregnation and optional drying can be carried out on a portion of one or both sheets. Thus, the stages C and/or D can be performed to impregnate and/or dry at least a part of at least one of the two sheets.

With the continuous method, at least part of one of the two connected and cut webs is conveyed through a bath 37 filled with a cosmetic solution. Depending on the intended packaging, a drying stage D can also optionally be provided in this variant after immersion in the bath 37, this drying preferably taking place before the final stage E in which the rectangle 36 is separated from the rest of the webs.

Although a single row of devices are illustrated, the invention is not limited to forming a single row of devices or to forming one device at a time. For example, a plurality of devices such as 1 may be produced simultaneously in the same web across the width of a web (or webs), depending on the width of the web. Further, a plurality of devices such as 1 may likewise be produced successively in the same web, depending on the length of the web.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device comprising:

a first sheet and a second sheet, the first sheet being connected to the second sheet in a connecting region;

a cavity formed between the two sheets on one side of the connecting region, wherein the cavity is accessible from an exterior of said device through at least one opening;

at least one flexible strip, formed by at least one of the first and second sheets, on another side of the connecting region opposite to the one side on which the cavity is formed;

wherein the two sheets respectively have a polygonal shape, and said cavity is oriented obliquely relative to said sheets, wherein said at least one flexible strip includes a plurality of flexible extensions, each of said plurality of extensions having a first end coupled to said connecting region and a second free end, said plurality of flexible extensions including at least one extension in which said second free end is spaced from a perimeter border of said one of said first and second polygonal sheets.

2. A device according to claim 1, wherein the at least one flexible strip is formed by both of the first and second sheets.

3. A device according to claim 1, wherein said plurality of flexible strips include flexible strips formed by said first sheet and flexible strips formed by said second sheet.

4. A device according to claim 1, wherein said plurality of flexible strips each include a first end coupled to said connecting region and a second free end.

5. A device according to claim 1, wherein said at least one flexible strip includes one end which is coupled to said connecting region and a second free end.

6. A device according to claim 1, wherein the flexible strip forms at least one fringe.

7. A device according to claim 6, wherein the at least one fringe comprises at least two flaps cut along an intermediate axis secant to a longitudinal axis of the fringe.

8. A device according to claim 1, wherein the connecting region forms at least one curve such that the cavity has at least one projection for accommodating at least one finger.

9. A device according to claim 8, wherein the connecting region delimits a plurality of projections, each for respectively accommodating one finger of a hand, and wherein at least one fringe extends from at least one of said projections.

10. A device according to claim 1, wherein the first and second sheets are superimposed.

11. A device according to claim 1, wherein at least one of the first and second sheets includes a nonwoven material.

12. A device according to claim 1, wherein at least a portion of at least one of said first and second sheets is impregnated with a cosmetic product.

13. A device according to claim 12, wherein said cosmetic product is a hair treatment product.

14. A device according to claim 1, wherein the connecting region is discontinuous.

15. A device according to claim 1, wherein said first and second sheets have a rectangular shape.

16. A device according to claim 1, wherein the at least one opening is positioned at a corner of adjacent sides of each of said first and second sheets, such that a portion of said at least one opening is defined between one side of said first sheet and one side of said second sheet, and such that a portion of said at least one opening is defined between a second side of said first sheet and a second side of said second sheet.

17. A device comprising:

first and second polygonal sheets connected to each other in a connecting region, each polygonal sheet having a perimeter border;

a cavity formed between said first and second polygonal sheets and on one side of said connecting region, and wherein said cavity is accessible through an opening such that a hand can be inserted into said cavity through said opening;

a plurality of flexible extensions extending on another side of said connecting region opposite to the one side on which the cavity is formed and wherein said plurality of flexible extensions are formed of at least one of said first and second polygonal sheets; and wherein said opening is positioned at a corner of adjacent sides of said polygonal sheets such that a portion of said opening is defined between one side of said first polygonal sheet and one side of said second polygonal sheet and such that a portion of said opening is defined between a second side of said first polygonal sheet and a second side of said second polygonal sheet, wherein each of said plurality of flexible extensions include a first end coupled to said connecting region and a second free end, and wherein at least one of said second free ends is disposed at a portion of one of said first and second polygonal sheets other than said perimeter border of said at least one of said first and second polygonal sheets.

18. A device according to claim 17, wherein said first and second sheets are rectangular.

19. A device according to claim 18, wherein said plurality of flexible extensions are formed from at least one of said first and second polygonal sheets, and wherein at least some of said plurality of flexible extensions comprise said first end coupled to said connecting region and said second free end at a perimeter of said at least one of said first and second polygonal sheets, and wherein said at least some of said flexible extensions are separated from each other at least at their respective second free ends.

20. A device according to claim 19, wherein said plurality of flexible extensions are formed from each of said first and second polygonal sheets.

21. A device according to claim 17, wherein said plurality of flexible extensions are formed from at least one of said first and second polygonal sheets, and wherein said second end of at least some of said plurality of flexible extensions is disposed at a perimeter of said at least one of said first and second polygonal sheets, and wherein said at least some of said flexible extensions are separated from each other at least at their respective second free ends.

22. A device according to claim 21, wherein said plurality of flexible extensions are formed from each of said first and second polygonal sheets.

23. A device according to claim 21, wherein said cavity has a plurality of cavity extensions with each for receiving at least one finger.

24. A device according to claim 23, wherein at least one extension of said plurality of flexible extensions is provided between adjacent ones of said plurality of cavity extensions.

25. A device according to claim 17, wherein said cavity includes five finger cavity extensions each for receiving a finger of a hand.

26. A device according to claim 25, wherein said plurality of extensions include at least:

a first group of extensions in which each second free end is disposed at a perimeter border of said one of said first and second polygonal sheets; and a second group of extensions in which each second free end is spaced from said perimeter border and is disposed adjacent to another second free end of said second group when said device is laid flat.

27. A device according to claim 26, wherein said second group of extensions extends between adjacent finger cavity extensions.

28. A device according to claim 17, wherein at least part of one of said first and second polygonal sheets is impregnated with a hair care product.

29. A device comprising:

first and second polygonal sheets connected to each other in a connecting region;

a cavity formed between said first and second polygonal sheets and on one side of said connecting region, and wherein said cavity is accessible through an opening such that a hand can be inserted into said cavity through said opening; and at least one flexible extension extending on another side of said connecting region opposite to the one side on which the cavity is formed and wherein said at least one flexible extension is formed of one of said first and second polygonal sheets, wherein said opening is positioned at a corner of adjacent sides of said polygonal sheets such that a portion of said opening is defined between one side of said first polygonal sheet and one side of said second polygonal sheet and such that a portion of said opening is defined between a second side of said first polygonal sheet and a second side of said second polygonal sheet, and wherein said at least one flexible extension includes a plurality of flexible extensions, each of said plurality of extensions having a first end coupled to said connecting region and a second free end, said plurality of flexible extensions including:

a first group of extensions in which each second free end is disposed at a perimeter border of said one of said first and second polygonal sheets; and a second group of extensions in which each second free end is spaced from said perimeter border and is disposed adjacent to another second free end of said second group when said device is laid flat.

30. A device comprising:

a first sheet and a second sheet, each of said first and second sheets having a perimeter;

a connecting region connecting said first sheet and said second sheet to define a cavity on one side of said connecting region and between said first sheet and said second sheet, and wherein at least part of said connecting region is spaced from the perimeter of at least one of said first and second sheets;

a plurality of flexible extensions formed by said at least one of said first and second sheets on another side of said connecting region opposite to the one side on which said cavity is defined, said plurality of extensions including at least:

a first group of flexible extensions having a first end coupled to said connecting region and a second end at the perimeter of one of said first and second sheets; and a second group of flexible extensions each having a first end coupled to said connecting region and a second end spaced from said perimeter of one of said first and second sheets, and wherein the second end of each flexible extension of said second group of flexible extensions is adjacent to and facing a second end of another flexible extension of said second group of flexible extensions when said device is laid flat.

31. A device according to claim 30, wherein the perimeter of each of said first and second sheets is rectangular.

32. A device according to claim 31, wherein said cavity includes a plurality of cavity extensions with each cavity extension for receiving at least one finger, and wherein said second group of flexible extensions extends between adjacent ones of said plurality of cavity extensions when the device is laid flat.

33. A device according to claim 30, wherein said cavity includes a plurality of cavity extensions, with each cavity extension for receiving at least one finger, and wherein said second group of flexible extensions extend between adjacent ones of said plurality of cavity extensions when the device is laid flat.

34. A device according to claim 30, wherein at least part of one of said first and second sheets is impregnated with a hair care product.

35. A device comprising:

a first sheet and a second sheet, the first sheet being connected to the second sheet in a connecting region;

a cavity formed between the two sheets on one side of the connecting region, wherein the cavity is accessible from an exterior of said device through at least one opening;

at least one flexible strip, formed by at least one of the first and second sheets, on another side of the connecting region opposite to the one side on which the cavity is formed;

wherein the two sheets respectively have a polygonal shape, and said cavity is oriented obliquely relative to said sheets, wherein at least part of one of said first and second sheets is impregnated with a hair care product, and wherein said at least one flexible strip includes a plurality of flexible extensions, each of said plurality of extensions having a first end coupled to said connecting region and a second free end, said plurality of flexible extensions including at least one extension in which said second free end is spaced from a perimeter border of said one of said first and second polygonal sheets.

36. A device comprising:

a first sheet and a second sheet, the first sheet being connected to the second sheet in a connecting region;

a cavity formed between the two sheets on one side of the connecting region, wherein the cavity is accessible from an exterior of said device through at least one opening;

at least one flexible strip, formed by at least one of the first and second sheets, on another side of the connecting region opposite to the one side on which the cavity is formed;

wherein the two sheets respectively have a polygonal shape, and said cavity is oriented obliquely relative to said sheets, wherein at least part of one of said first and second sheets is impregnated with a hair care product, and wherein said at least one flexible strip includes a plurality of flexible extensions, each of said plurality of extensions having a first end coupled to said connecting region and a second free end, said plurality of flexible extensions including:

a first group of extensions in which each second free end is disposed at a perimeter border of said one of said first and second polygonal sheets; and a second group of extensions in which each second free end is spaced from said perimeter border.

* * * * *